US008807487B2

(12) United States Patent
Ring

(10) Patent No.: US 8,807,487 B2
(45) Date of Patent: Aug. 19, 2014

(54) CONTROL SYSTEM FOR SIMPLIFYING CONTROL OF A MODEL RAILROAD

(76) Inventor: Timothy W. Ring, Schererville, IN (US)

( * ) Notice: Subject to any disclaimer, the term of this patent is extended or adjusted under 35 U.S.C. 154(b) by 168 days.

(21) Appl. No.: 13/334,162

(22) Filed: Dec. 22, 2011

(65) Prior Publication Data

US 2012/0160969 A1 Jun. 28, 2012

Related U.S. Application Data

(60) Provisional application No. 61/427,294, filed on Dec. 27, 2010.

(51) Int. Cl.
*B61L 3/00* (2006.01)

(52) U.S. Cl.
USPC ..... 246/187 A; 246/187 R

(58) Field of Classification Search
USPC ..... 246/167, 187 A, 187 B, 187 R, 218; 701/19; 104/295
See application file for complete search history.

(56) References Cited

U.S. PATENT DOCUMENTS

| | | | | | |
|---|---|---|---|---|---|
| 3,268,727 | A * | 8/1966 | Shepard | 246/187 A |
| 4,335,381 | A * | 6/1982 | Palmer | 340/12.32 |
| 5,012,749 | A * | 5/1991 | Passage, Jr. | 104/297 |
| 5,251,856 | A * | 10/1993 | Young et al. | 246/4 |
| 5,297,484 | A * | 3/1994 | Piserchia et al. | 105/1.5 |
| 5,346,163 | A * | 9/1994 | Momma et al. | 246/5 |
| 5,441,223 | A * | 8/1995 | Young et al. | 246/4 |
| 5,448,142 | A * | 9/1995 | Severson et al. | 318/280 |
| 5,749,547 | A * | 5/1998 | Young et al. | 246/4 |
| 6,109,186 | A * | 8/2000 | Smith et al. | 104/295 |
| 6,457,681 | B1 * | 10/2002 | Wolf et al. | 246/187 A |
| 6,536,716 | B1 * | 3/2003 | Ireland et al. | 246/187 A |
| 6,619,594 | B2 * | 9/2003 | Wolf et al. | 246/187 A |
| 7,132,807 | B2 * | 11/2006 | Zahornacky | 318/53 |
| 7,211,976 | B2 * | 5/2007 | Denen et al. | 318/286 |
| 7,312,590 | B1 * | 12/2007 | Kovach et al. | 318/268 |
| 7,328,872 | B2 * | 2/2008 | Zahornacky | 246/219 |
| 7,437,642 | B1 * | 10/2008 | Ricks et al. | 714/732 |
| 7,549,610 | B1 * | 6/2009 | Ireland | 246/1 C |
| 7,618,011 | B2 * | 11/2009 | Oleski et al. | 246/167 R |
| 7,726,612 | B1 * | 6/2010 | Ireland | 246/1 C |
| 7,880,413 | B1 * | 2/2011 | Kovach et al. | 318/268 |
| 8,013,550 | B1 * | 9/2011 | Young et al. | 318/268 |
| 8,025,545 | B2 * | 9/2011 | Zahornacky et al. | 446/25 |
| 8,262,034 | B2 * | 9/2012 | Wolf et al. | 246/187 A |
| 2006/0151673 | A1 * | 7/2006 | Ritota et al. | 246/187 A |
| 2008/0023593 | A1 * | 1/2008 | Ritota et al. | 246/187 A |
| 2010/0148938 | A1 * | 6/2010 | Young et al. | 340/10.31 |
| 2012/0160969 | A1 * | 6/2012 | Ring | 246/187 A |

* cited by examiner

*Primary Examiner* — Jason C Smith
(74) *Attorney, Agent, or Firm* — James Ray & Assoc.

(57) ABSTRACT

A control system for at least a pair of motor powered rail vehicles coupled together in a model train railroad includes a controller, a control module installed on each of the at least pair of motor powered rail vehicles, a bi-directional communication between the controller and at least one control module in one of the at least pair of motor powered rail vehicles, a bi-directional communication between the at least pair of control modules, and at least one of the controller and the one of the pair of control modules configured to store in memory full load electrical power value and use the full load electrical power value in adjusting motor load for a respective motor powered rail vehicle. The control system also uses a subsonic motor signal to enhance low speed operation of rail vehicles and a graphical interface within the controller and capability to utilize previously unknown devices.

20 Claims, 10 Drawing Sheets

CONTROL SYSTEM FOR SIMPLIFYING CONTROL OF A MODEL RAILROAD

CROSS-REFERENCE TO RELATED APPLICATIONS

This application is related to and claims priority from U.S. Provisional Patent Application Ser. No. 61/427,294 filed on Dec. 27, 2010.

FIELD OF THE INVENTION

This invention relates, in general to model railroading and, more particularly, the invention relates to a means for simplifying the control of energy that causes action, lights, sound, movement of trains, and operation of accessories in a model railroad environment.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

The model railroad industry, as is well recognized in the art, has always sought additional ways to make model trains and associated accessories operate as realistically as possible. Many improvements have been made making the model railroad more realistic, however all have been typically complex as well as difficult for users to understand and operate.

Many of the more modern control systems used in model railroad control functions are using digital technology. The use of digital technology has added a layer of complexity for the model railroad operator; however it has greatly enhanced the realism which can be attained with model railroad trains and accessories. The most common way this is done is by following a standard published by the NMRA (National Model Railroad Association) commonly known as DCC (Digital Command Control). This standard is generally accepted by the model railroad industry and many vendors manufacture model railroad control devices that are compatible with the standard.

Prior to the present invention, these hand held devices all use cryptic throttles, button type keypads, text based displays, and user interfaces that are not user friendly and not very convenient to use. In most cases the hardware that is being controlled needs to be programmed by the end user before using it. With these types of controllers and accessories, a reasonably educated user with knowledge of electricity, some exposure to digital electronics as well as some knowledge and use of computers would still find these units difficult to initialize, configure and operate. The present invention serves to solve these problems.

SUMMARY OF THE INVENTION

The invention is directed at model railroading and in particular, model railroading control. The invention described herein teaches a means for simplifying the control of a model railroad, its trains and accessories. The invention makes use of at least one power supply, at least one hand held controller (throttle), preferably with a graphical touch screen for display, and at least one control module. As in other model railroad control systems, the power supply will supply power for the accessories on the model railroad including the power for locomotives, switch tracks, and any other accessories that require energy for action, lights, sounds, and movement of trains and accessories. Configuration and use of the control module is accomplished with a minimum of steps as most of the configuration information is stored within the module and can be preprogrammed before being used. With this type of stored configuration information, the user can simply turn on the power supply, turn on the hand held controller, touch a "find button" to cause the hand held controller to go "find the control module". Once found, the hand held can load the pre-configured information from the control module to the hand held and basically tell the hand held how to control itself. At this point, all the user needs to do is touch an icon or picture of the control module (or whatever it is controlling) in order to select that device for control. This can be done for anything that is controllable on a model railroad layout including locomotives, switch tracks, lights, gates, sounds, and other accessories.

OBJECTS OF THE INVENTION

It is, therefore one of the primary objects of the presently preferred invention to simplify the means of control of a model railroad.

Another object of the present invention provides a means to improve the functionality of the model train control system.

A further object of the present invention is to provide a means for the control system to allow for fast control of a model railroad device by simply touching an icon or picture of the device to be controlled on the graphical touch screen hand held controller (throttle).

Still another object of the present invention is to provide an apparatus and method for all system components to have the ability to hold configuration data making them all "smart components" which allows for simplified set up and use.

Yet another object of the invention is to provide a means of protecting system components by password protection to keep other system users from accidentally controlling things they should not or to isolate particular controlled devices to specific users in a multi user environment.

A further object of the invention is to provide a means to allow multiple controllers and multiple controlled devices without the need for a master controller to provide coordination.

Still another object of the invention provides a means and apparatus for communication and feedback for a closed loop control system where necessary using RF (radio frequency).

Yet another object of the invention provides a means for the control system to detect and control any controllable device without the need for the operator to enter any address data or configuration data.

A further object of the invention is to provide a means of improved performance while adjusting parameters of the controlled devices including but not limited to locomotive speed control, and settings for most other parameters and configuration data that is desired to be modified by use of a hall effect device coupled to a rotary control knob for increased resolution.

Still another object of the invention provides a means for user configurable buttons, graphics, and control functions.

Yet another object of the invention provides a means for graphics to be used to demonstrate the state of a given device, such as that of a "turn out", which, in the turn out case, graphics can be used to demonstrate whether the switch is set to go straight or towards the turn out.

A further object of the invention is to provide a means and apparatus for the control system devices to have their software updated easily for enhanced and/or improved performance in the future.

Still another object of the invention provides a means to download files from the internet to the throttle which can in turn send via RF signal to any control module in order to update the software on any control device included in the system.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
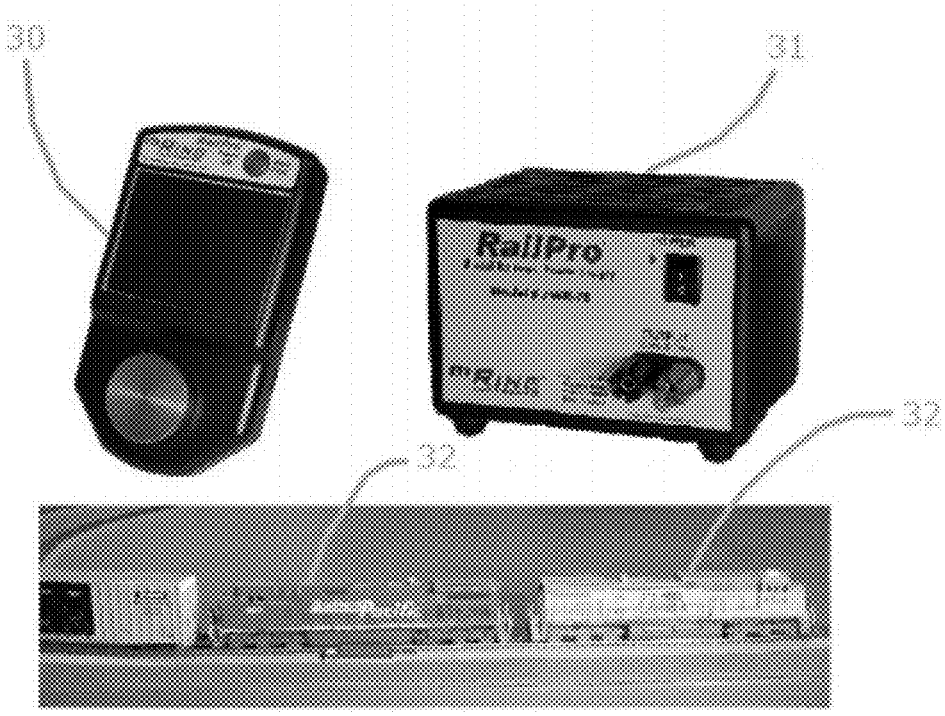
FIG. 1 is a graphic showing the major components of the train control system.
Figure 2:
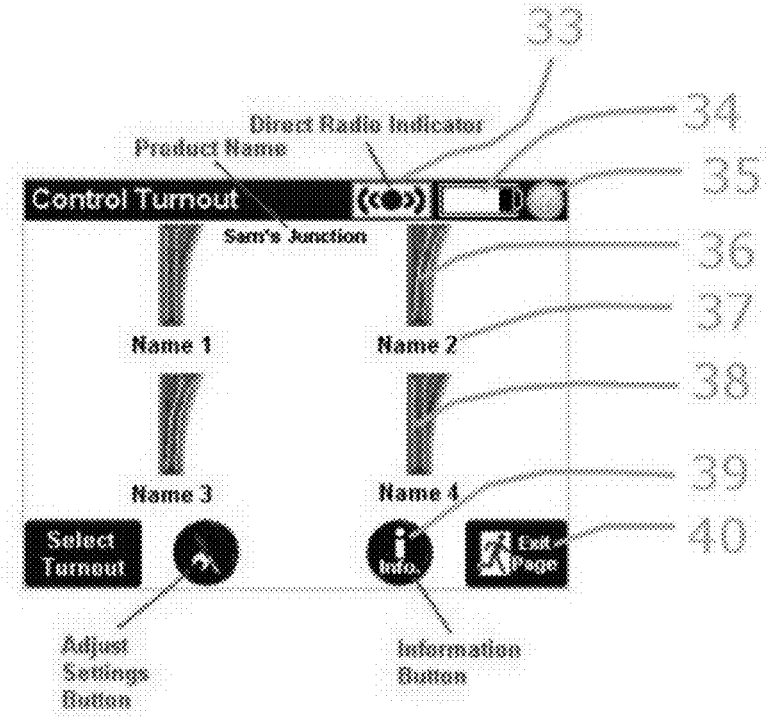
FIG. 2 is an image of a typical control screen shown on the hand held controller (throttle), particularly used for the control of switch tracks.
Figure 3:
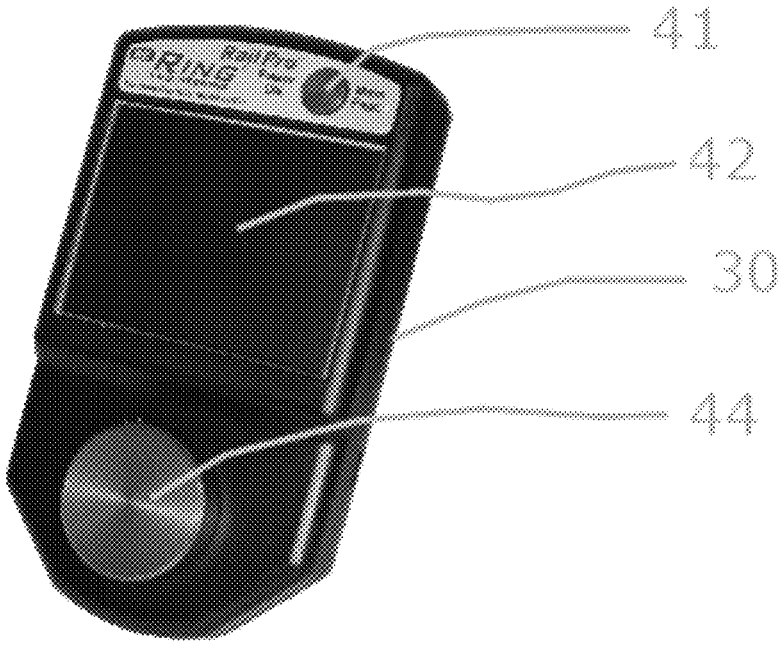
FIG. 3 is an image of a hand held controller or throttle with a graphical touch screen and knob for operator controlled adjustments.
Figure 4:
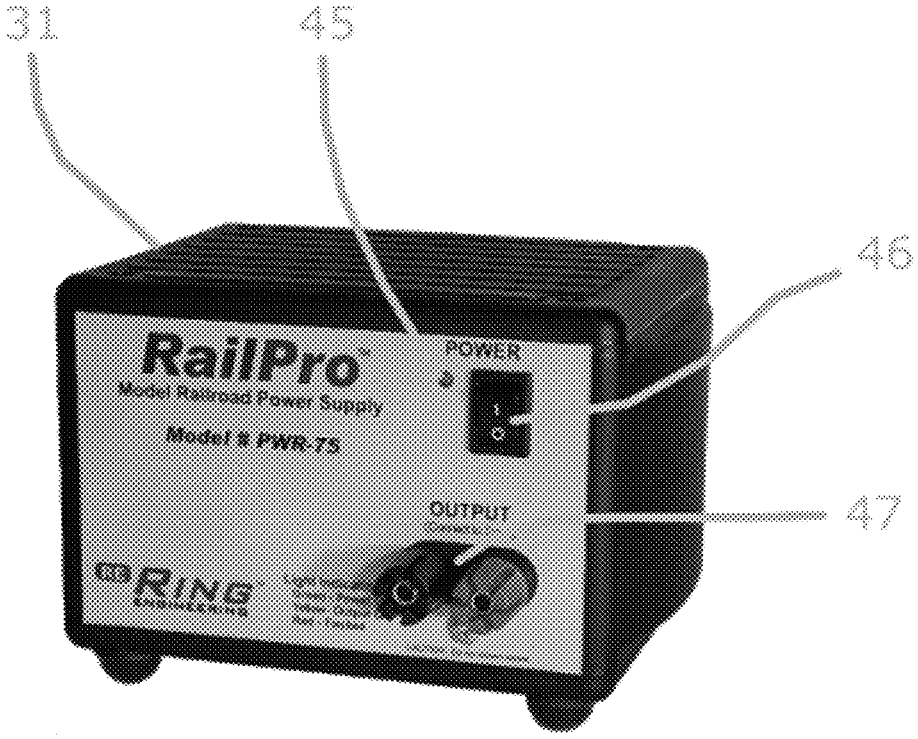
FIG. 4 is an image of a power supply.
Figure 5:
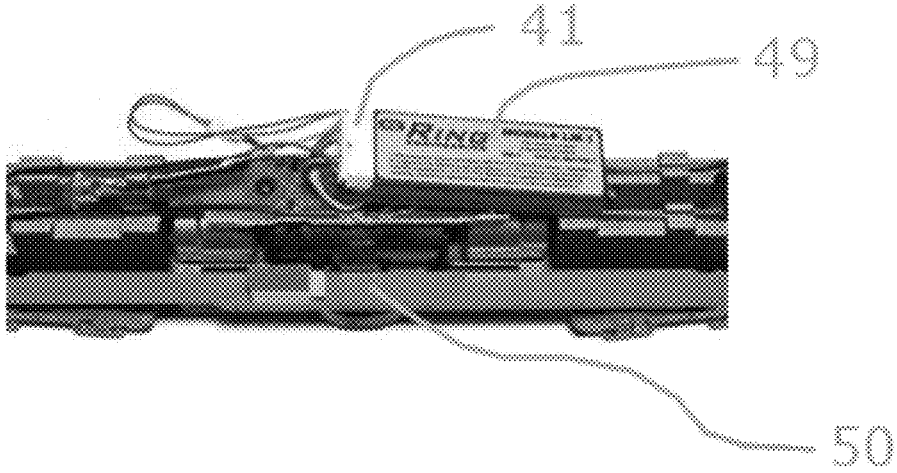
FIG. 5 is an image of a control module installed on a model railroad locomotive chassis with the shell removed.
Figure 6:
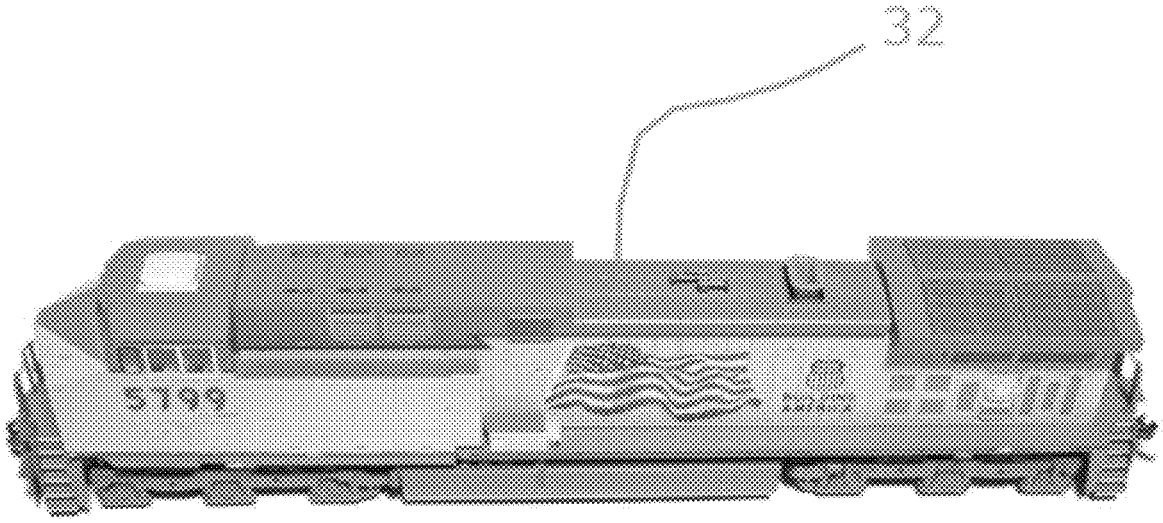
FIG. 6 is a model railroad locomotive with a control module installed and its outer shell in place.
Figure 7:
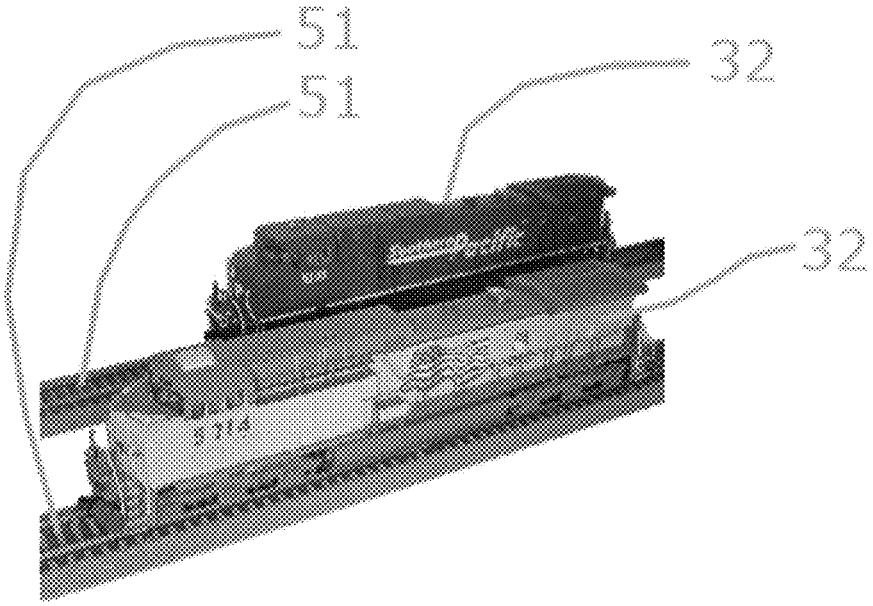
FIG. 7 is a pair of model railroad locomotives with control modules installed and on tracks.
Figure 8:
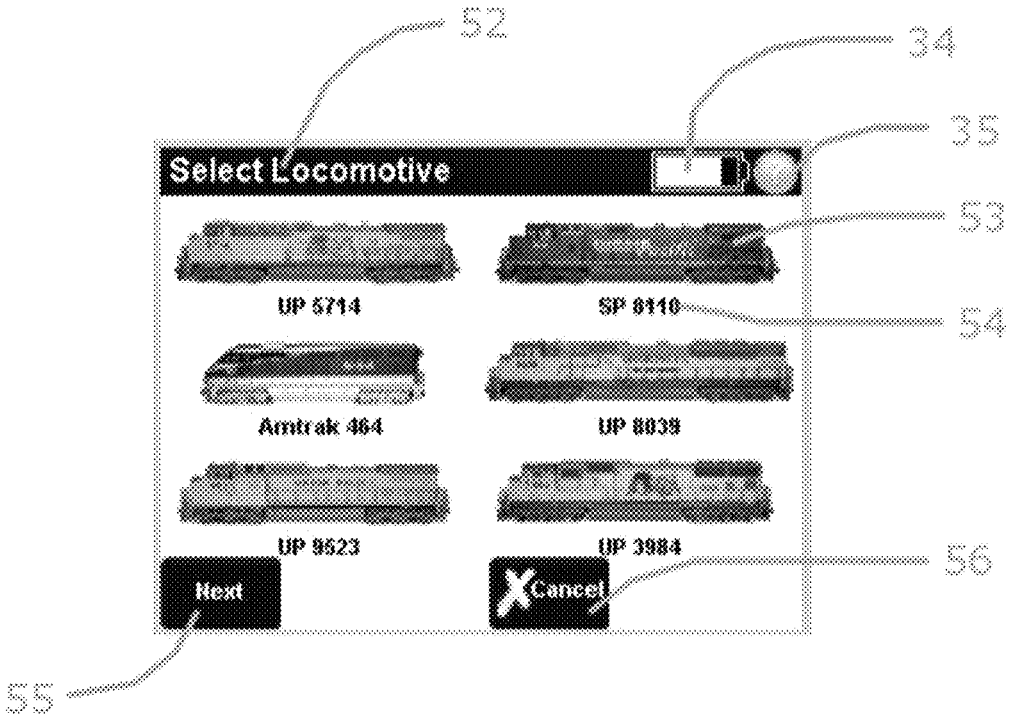
FIG. 8 is a model railroad locomotive selection screen that shows up on the hand held throttle.
Figure 9:
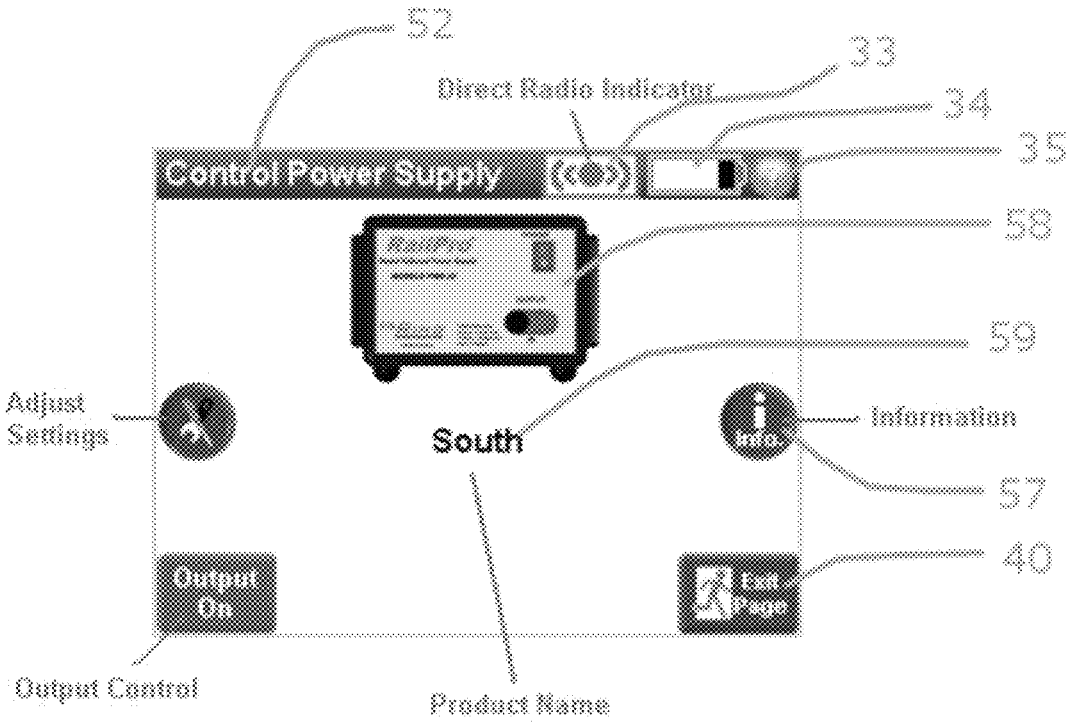
FIG. 9 is a power supply control screen that shows up on the hand held throttle for configuration of the power supply.
Figure 10:
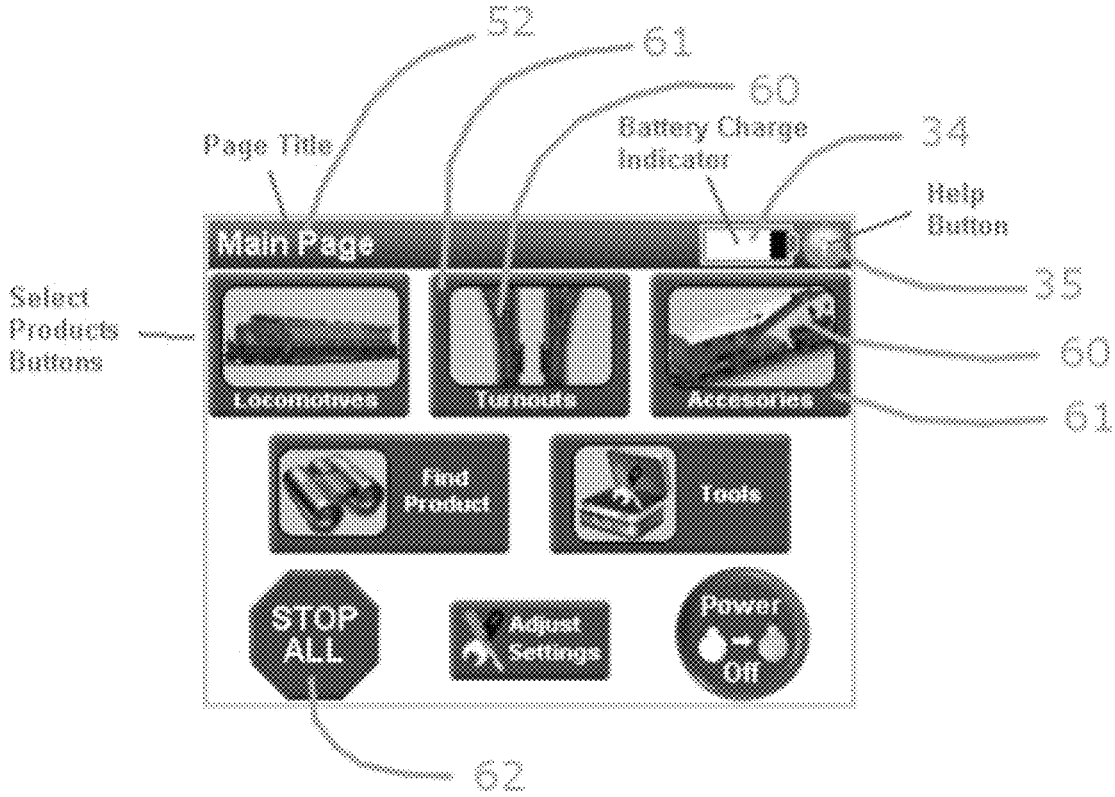
FIG. 10 is the main page control screen that shows up on the hand held throttle.
Figure 11:
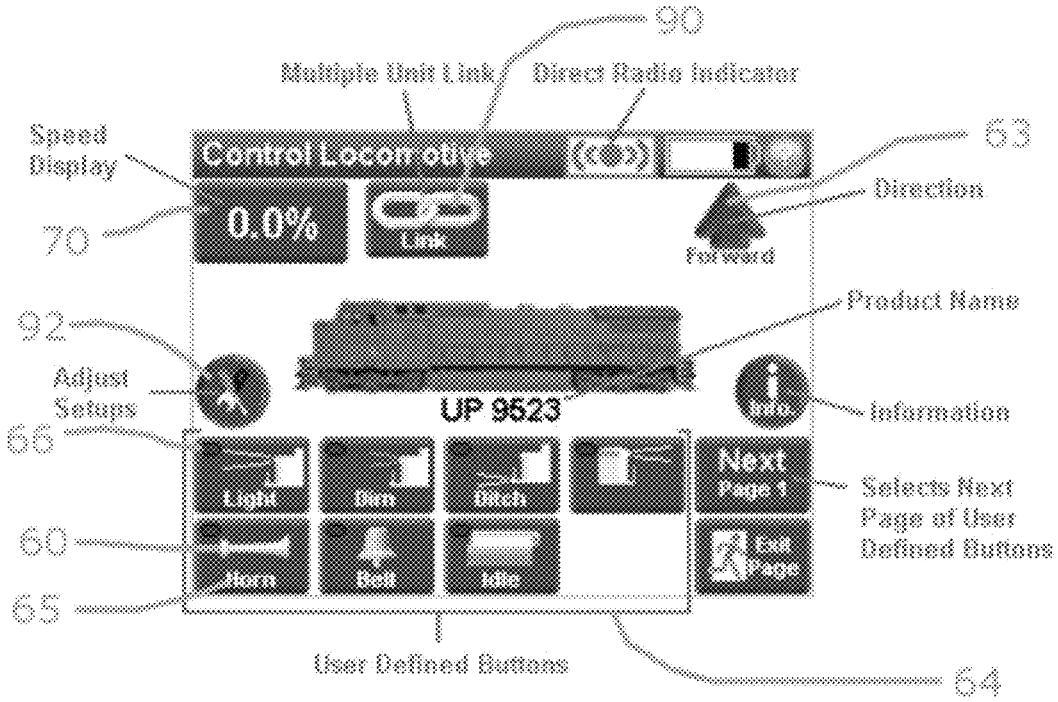
FIG. 11 is a model railroad locomotive control screen that allows a user to access all functions needed for locomotive control.

Prior to proceeding to the more detailed description of the present invention, it should be noted that, for the sake of clarity and understanding, identical components which have identical functions have been identified with identical reference numerals throughout the several views illustrated in the drawing figures.

With that, the presently preferred invention of the control system for controlling operation of at least a pair of motor powered rail vehicles, or locomotives 32, consists of at least one hand held control device or controller 30, at least one power supply 31, and at least one control module 87 that may be used to control any model railroad accessory or locomotive. The controller 30 is also referred in this document as a "throttle". Although many other configurations can exist, this minimal number of devices provides the most basic system for ease of explanation, although more complex systems can exist.

The presently preferred simplified control system makes use of many concepts, when coupled together make for a unique system in order to reduce the complexity and improve the functionality of the system's performance. For example, in the presently preferred system, operator can control a locomotive 32 with a touch of a picture 53 on the graphical handheld controller 30. This saves the steps of keying in an address such as the typical four digit locomotive address that other, less modern systems use.

Another concept used to help simplify the user control experience is to store configuration information in memory 86 of the control module 87 that other controllers 30 can detect and add locally. Since these control modules 87 have memory 86, files can be sent to and received from the control modules 87 to enhance their operation. Examples would be image files of a specific locomotive 53 that could be displayed on the hand held throttle 30 screen 42. Of course sound files, light effect files, and other types of information can also be transmitted, received, and stored.

In order to transmit these files to the control modules 87, the hand held throttle 30 and the control modules 87 as well as the power supply 31 all have bi-directional Radio Frequency (RF) communication 82 capability.

Each control module 87 can be given a unique (user chosen) name 54 to make selection easier. This is similar for all control modules 87 which can be installed on different types of model railroad accessories such as switch tracks 88 as well as locomotives 32. Controllable model railroad accessories can be, but not limited to things like crossing gates, railway signals, control modules 87 used for farm animal sounds near farms, controlling lights in buildings, or any other controllable function on the model railroad.

The controllers 30 themselves can detect new devices (control modules 87) and load information from them automatically. The devices, such as locomotives 32 or accessories, in which the control module 87 is installed can hold pictures in memory 86 that represent the particular device.

Figure 17:
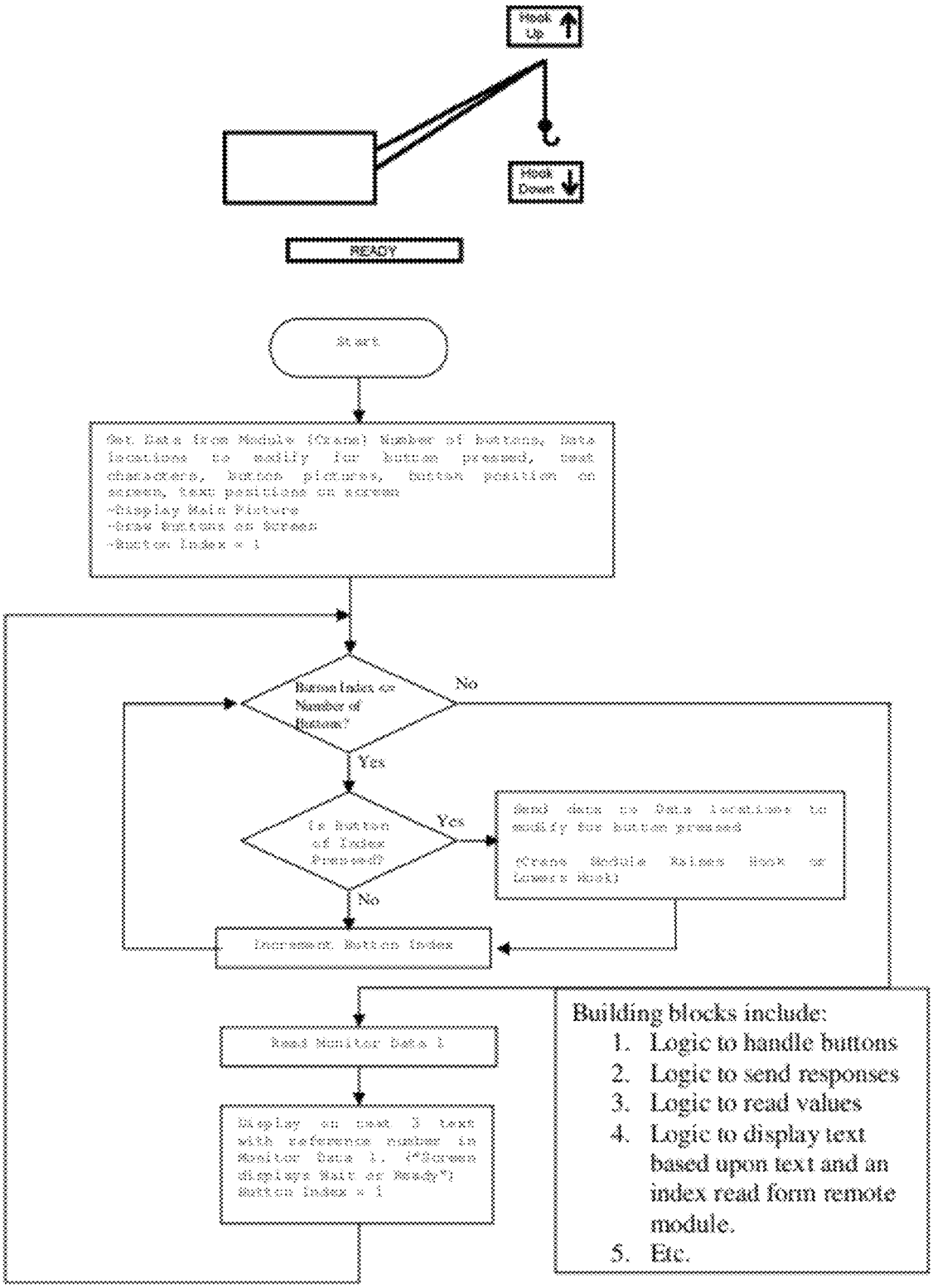
FIG. 17 shows a flow chart demonstrating typical logic used to configure a previously unknown device and act on user input as well as to display feedback from the controlled device. Controlling a crane is used as an example.
Figure 18:
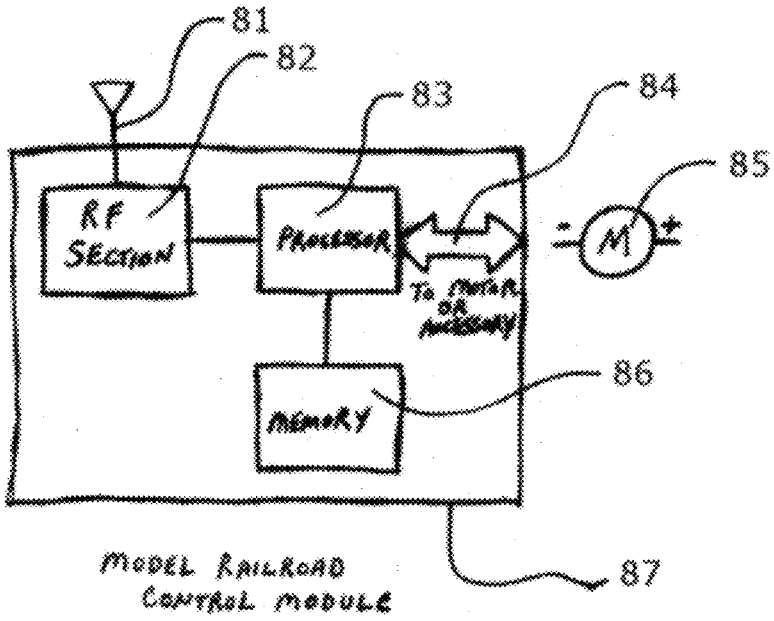
FIG. 18 is a drawing of the major subsections of each model railroad control module.
Figure 19:
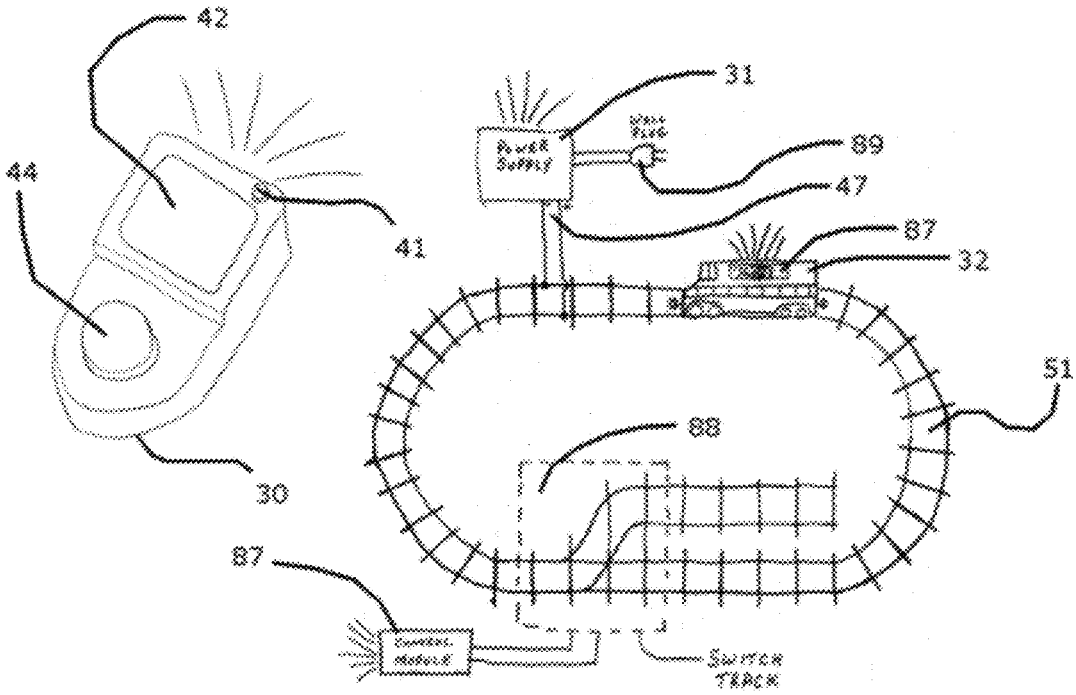
FIG. 19 is a drawing showing the major components of the model train control system.

The controllers 30 can detect and load devices that the controller 30 has no previous knowledge of. The device loaded may have not existed when the software in the controller 30 was acquired, and the controller 30 can still allow control of the devices. This is technically feasible due to the fact that the device contains a file in its memory that describes functionality based upon a known framework or building blocks of digital information. More particularly, each new device contains identification information, including graphical representation of such device, as well as operating parameters. An example flow chart demonstrating this concept is shown in FIG. 17.

RF communication and control can be used in a wide variety of environments and there exists a need to limit the control of a wireless system. Each control module 87 can have its own unique password 72. Passwords can be reset by use of cycling the power. This is effective in that if you have physical access to the controlled devices it is expected that you are an owner or trusted user and would provide sufficient protection from foreign users. Cycling power is a way of resetting a device without adding extra inputs, buttons, or switches.

The model railroad control system can have multiple hand-held controllers or throttles 30 and operate multiple controlled devices containing control modules 87 without a need for a separate or independent master controller for coordination. The throttles 30 can transmit/receive data directly to the controlled devices (containing control modules 87).

Throttles 30, control modules 87, accessory modules (containing control modules 87) and power supplies 31 can all communicate with each other. For instance, on a "Stop All" button 62 press, each controller can have previously detected the other controllers 30 that will be in use in the system and send the "stop all" command to those controllers 30, i.e. one controller 30 can send messages to another controller 30. Bi-directional RF communication makes this possible and is improved over older technology which sends commands through the track and stores all command messages in a master controller.

The throttles (controllers) 30 can use one or more repeaters to connect to the devices containing control modules 87. The devices with control modules 87 would have RF transmitter/receivers built in to them and any of them can function as a repeater. Typically, only stationary control modules 87, like those contained in the power supply 31, and accessory module 78, would be used as a repeater. Although it can be accomplished, it is not usually a good idea to have a moving device with a control module to function as a repeater.

Since all of the control system devices of the preferred system are capable of bi-directional RF communication, the device control modules 87 can provide feedback to throttles 30 or to other control modules 87. This is an improvement over the older systems on the market as they are only one-way transmissions from the power supply to the locomotives and accessories.

Feedback can consist of fault information and real time status data. The device control modules 87 can send status data from one device control module 87 to another. This is particularly effective in turnouts 88 which can send position information to the control modules 87 when they are in a particular position (straight 38 or turned out 36). This information can then be transferred to the hand held throttle 30 for display or used by another control module 87 for driving track signals.

Figure 12:
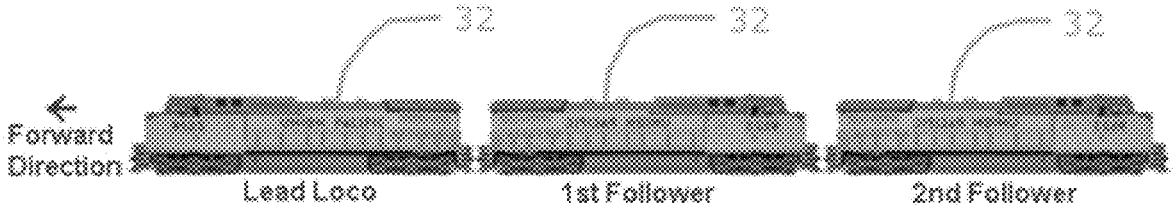
FIG. 12 is an image of consisted locomotives.
Figure 13:
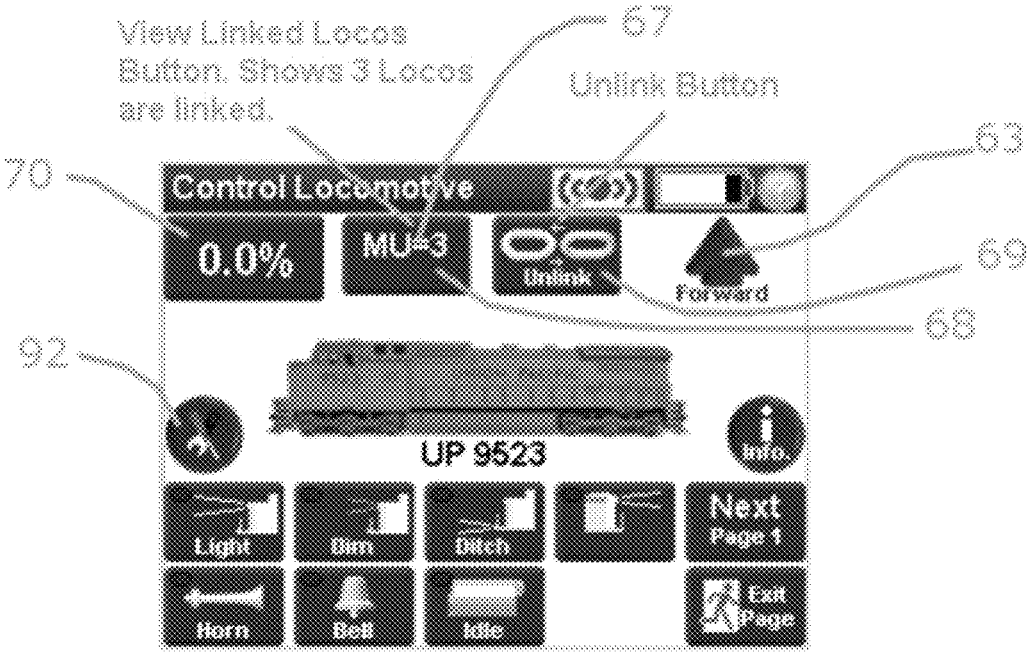
FIG. 13 is a locomotive control screen graphic that shows 3 locomotives tied together to work as one (Multi Unit).
Figure 14:
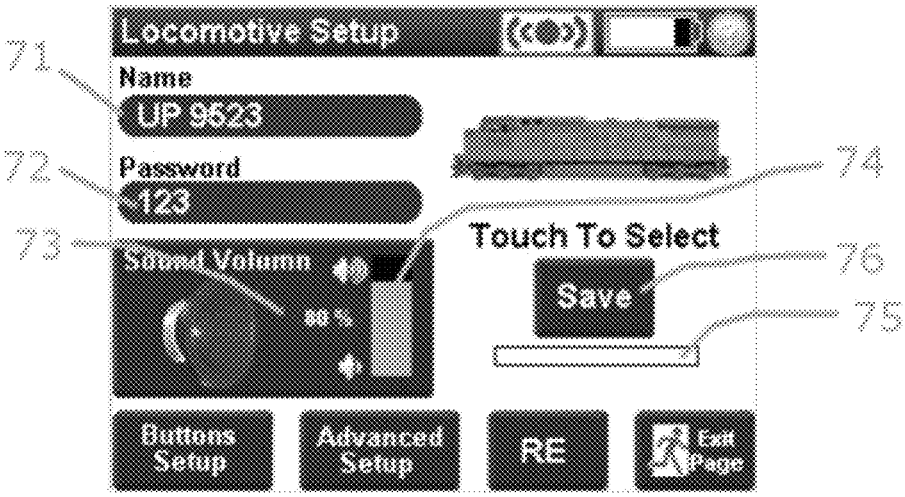
FIG. 14 is an image of a locomotive setting screen that shows up on the hand held throttle.
Figure 15:
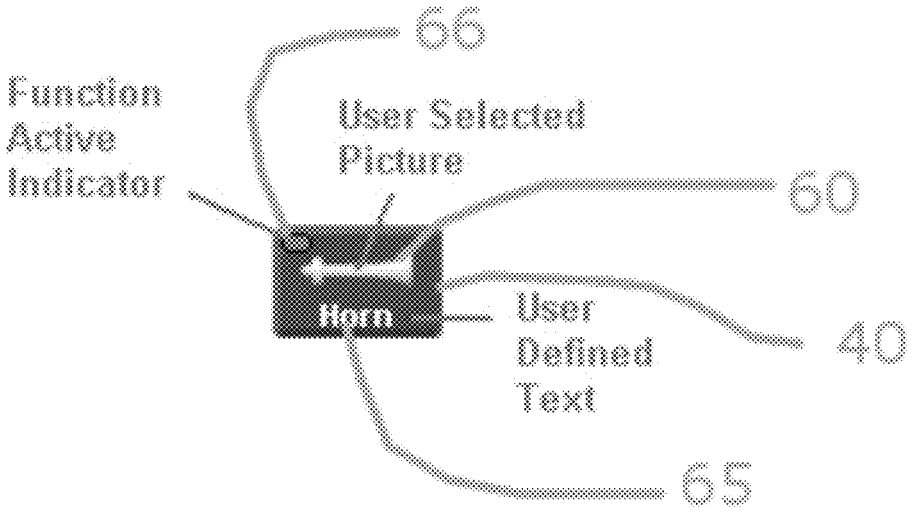
FIG. 15 is a graphic of the features that can be included on a single button of the hand held throttle to make it user intuitive.
Figure 16:
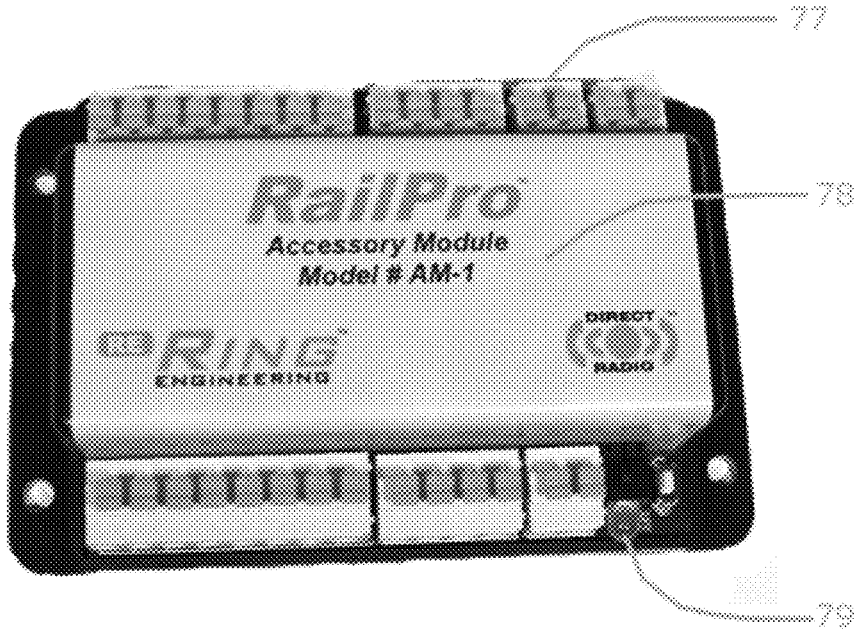
FIG. 16 is an image of an accessory control module that can be used to control such items as switch tracks.

Direct bi-directional RF capability allows Multiple Unit consisting (FIG. 12) of locomotives 32 that can be controlled as one while being coupled together. With that said, the lead locomotive 32 can be using open loop control with just a reference command signal to adjust to. The locomotive motor power can be monitored by the control module 87 in the locomotive 32 and sent to follower locomotives 32. All follower locomotives 32 would be configured for closed loop power regulation to match the lead locomotive 32. All locomotives in the consist will then pull with the same power and self regulate for variables that change load on the consist; such as overcoming static friction during movement initiation, trailing model railroad cars forming a train that maneuvers through vertical and horizontal curves, change in track voltage at various locations of the layout, etc. The designated lead locomotive 32 can transmit the information directly to the followers 32, transmit to them through repeaters, or transmit the info back to a controller 30 that can then pass the information to the followers 32.

The power values of the motor loads are defined or measured by a motor current. One of the controller 30 and the at least one control module 87 execute a predetermined logic including at least one of a drop power calculation by way of multiplying motor current squared by resistance and motor losses represented by power loss in windings of the motor. At least one control module 87 is configured to use the full load power value at full slip of a respective vehicle 32 as a close equivalent of a full power value of a respective motor. At least one control module 87 is configured to receive a preselected power value so as to maintain tension between couplers of the at least pair of rail vehicles 32.

At least one control module 87 is configured to vary voltage on a motor of a respective rail vehicle 32 in accordance with a periodic wave shape, preferably subsonic between about 2 and 20 Hz with an approximate triangular shape, so as to overcome static friction of the respective rail vehicle 32 and improve performance thereof at a generally low speed.

When considering the static friction of a consisted, multiple locomotive train, getting it started in motion takes substantially more power than it does to keep it moving at a specified speed. With that, an advantage exists when using bi-directional communication between the locomotive control modules 87 and sharing the power value between the consisted locomotives with only one known parameter stored in memory 86, that is the full power value at full slip. Full slip is defined when maximum control system voltage is applied to the locomotive motor through the control module 87 and it is held from movement with only the locomotive weight affecting the vertical load on its wheels. When the locomotive is in the "full slip" state, a motor "full power value" is stored in memory thus characterizing that particular locomotive motor. When used in practice, the designated lead locomotive 32 would be sent a reference command signal from a controller 30 in which a locomotive motor power value would then be measured from the designated lead locomotive's motor by the control module 87 and relayed to the follower locomotive(s) 32. By doing this continuously, the follower locomotive(s) 32 will follow the lead locomotive's power reference and automatically regulate to share load about evenly through the breaking of static friction, curves, turnouts, and any other cause of load changes affecting the model train. As an example, when the lead locomotive 32 is sent a reference command signal to begin movement, its motor power will increase until static friction is broken, then the motor power will reduce in order to maintain a steady roll. Since the follower locomotives 32 are continuously receiving the lead locomotive's motor load value, they too are continuously adjusting for a good match in pulling power. This match is simply a percentage of full motor power for each individual locomotive as defined when they had their full load motor value stored in memory during their full slip calibration. This series of control steps allows for better and more accurate control during very low velocity train movement as well as it self-compensates for consisted locomotives with different motor characteristics, differing gear ratios, differing internal and external drag resistances, etc. In cases where the locomotives are very closely matched and couplers between consisted locomotives are loose, a slightly modified motor value command signal can be transmitted to the followers in order to keep the couplers tight and sharing load as evenly as possible.

The use of repeaters also extends the effective range of any device with a bi-directional transmitter/receiver. Multiple repeaters can be used to gain full coverage of the model railroad if necessary which cause multiple paths of communication between devices and eliminating multi-path distortion.

Most all other older technology speed controlled locomotives with speed differences and operating on different control modules will literally have one locomotive pulling with a majority of the power while the other is actually hindering and limiting the total train pulling strength to possibly less than the pulling strength of a single locomotive. These older technology control systems would make use of speed tables programmed by the user for each individual locomotive and at many different speeds (control variables) in order to characterize the locomotive motor performance and get them to run better when consisted. In many cases, it was preferred to use a speedometer in order to measure the speed when recording and storing these values in a speed table. This is a time consuming and substantial feat for the average user of digital model railroad control equipment. The present invention simplifies and corrects for this problem.

As above, there are other drawbacks to the use of "speed tables" used for locomotive matching. The cost of extra measuring equipment, programming track, learning to use computer software for calibration, etc., which is also time consuming. When speed tables are used in the older digital systems, the results are usually not as expected by the user. Users find that speed table matched locomotives will vary in performance due to changing motor characteristics when the train is lengthened or shortened, thus changing the load on the locomotives. Using the same speed table variable values between otherwise identical locomotives will also not yield the expected results due to manufacturing tolerances and internal resistance and drag differences. Speed matching has many inherent problems that the present invention solves using continuous motor power regulation.

Locomotive motor current can also be used as a good approximation of motor power. A locomotive motor current can be used to continuously match the followers to the lead locomotive.

The controllers 30 can also detect and control accessories (with control modules 87) without the user entering any addresses or digital signatures to differentiate between control modules 87, handhelds 30 or power supplies 31. This technically feasible because each control module 87, controller 30, power supply 31, or accessory module 78 each have a unique serial number or address designated to them at the factory when produced. Each device on the model train system is then uniquely identifiable by the other devices on the model railroad.

A Hall Effect device can be used in combination with a rotary knob 44 to adjust parameters on the devices, meaning all devices within the model train control system including but not limited to control modules 87, accessory modules 78, power supplies 31 and other controllers 30. The most widely used adjustment for the knob 44 utilizing the Hall Effect device is locomotive speed 70. It is currently used to make most adjustments within the model train control system, just typically less frequently than the locomotive speed 70. Older control systems made use of mechanical switch knobs that are usually limited to about 24 pulses per revolution. With a Hall Effect sensor, over 1000 unique locations can be detected in a single revolution. This gives the user both fast speed adjustments in which about one full revolution is all that is necessary to go from full speed to zero speed, instead of many revolutions like the older technology. In some older technology, the speed control knob had end stops and was not of the continuous rotation type. These had to be "speed synchronized" upon changing from one locomotive to another which was again troublesome for the user.

Also, to improve low speed operation, the preferred system utilizes an electro-motive force pattern on the rail vehicle motor to cause the static friction of the motor to be broken. A subsonic triangular pattern in the two to twenty hertz range has been found to be effective for HO scale locomotives. This pattern is reduced as the speed of the locomotive 32 is increased.

The controllers 30 and controlled devices with control modules 87 can have their software updated. Controllers 30 can use a port to connect to the internet to get software updates. Controlled devices with control modules 87 can receive updates from controllers 30.

The user can also configure the buttons on the screen of the throttle 30 to control his particular device. The button position, picture 60, text 65, and action can all be set by the user to suit their individual preference.

Furthermore, in combination with a model train railroad including at least one motor powered rail vehicle 32 having a control module 87 provided therewithin and containing at least one identification parameter and at least one operating parameter of said at least one motor powered rail vehicle, a controller 30 is configured to interrogate the control module 87 and at least import such at least one identification parameter and such at least one operating parameter.

The controller 30 may have a housing being so sized and shaped that the controller 30 is held by an operator of the model train railroad. Equally as well, the controller 30 preferably includes at least one graphics based operator interface. The at least one graphics based operator interface is configured to upload configuration information contained therewithin to the control module 87. The at least one graphics based operator interface includes a graphical touch screen providing selection of control functions, wherein each control function is represented by a unique icon on the touch screen for use by the operator of the model train railroad. The controller 30 is configured to store, in memory, a file structure containing graphical images and other information required for control of the at least one motor powered rail vehicle 32 in a predetermined framework. The model train railroad may further includes at least one train accessory and wherein the at least one operator interface is configured to control the at least one train accessory.

Although the present invention has been described and illustrated in combination with a model railroad, it will be apparent to those skilled in the art, that the present invention may be applied to other control systems, for example in controlling operation of rail vehicles used for passenger and/or freight service.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In a combination with a model train railroad including a lead motor powered rail vehicle and at least follower motor powered rail vehicles coupled together, a control system comprising:

(a) a control module installed on each of said lead motor powered rail vehicle and said at least one follower motor powered rail vehicle, (b) a controller at least in a communication with said control module on said lead motor powered rail vehicle, said controller generating command signals to be transmitted to said control module on said lead motor powered rail vehicle, wherein one of said command signals is a movement reference control signal, (c) a bi-directional communication between said control module on said lead motor powered rail vehicle and said control module on said at least one follower motor powered rail vehicle, (d) wherein said control module on said lead motor powered rail vehicle communicates a motor power value to said control module on said at least one follower motor powered rail vehicle, and (e) whereby said control module on said at least one follower motor powered rail vehicle adjusts a motor power of said at least one follower motor powered rail vehicle so as to match said motor power value communicated thereto from said control module on said lead motor powered rail vehicle.

2. The model train control system, according to claim 1, wherein said motor power value is defined or measured by a motor current.

3. The model train control system, according to claim 2, wherein said controller and said control module execute a predetermined logic including at least one of a drop power calculation by way of multiplying motor current squared by resistance and motor losses represented by a power loss in windings of a motor.

4. The model train control system, according to claim 1, wherein at least one control module uses said power value at a full slip of a respective motor powered rail vehicle as a close equivalent of a full power value of a respective motor.

5. The model train control system, according to claim 1, wherein at least one control module uses said motor power value to maintain a tension between couplers of said lead motor powered rail vehicle and at least one follower motor powered rail vehicle.

6. The model train control system, according to claim 1, wherein at least one control module varies a voltage on a motor of a respective motor powered rail vehicle in accordance with a periodic wave shape of a subsonic type between about 2 and 20 Hz with an approximate triangular shape, so as to overcome a static friction of said respective motor powered rail vehicle and improve a performance of said respective motor powered rail vehicle at a generally low speed.

7. The model train control system, according to claim 1, wherein said model train railroad includes at least one accessory having a control module installed therewithin and wherein said control system operates said at least one accessory.

8. The model train control system, according to claim 1, wherein said controller includes a graphics based operator interface.

9. The model train control system, according to claim 1, wherein said control module calibrates a full slip condition and stores a resulting full load motor value in a memory.

10. The model train control system, according to claim 1, wherein said controller includes a Hall Effect device in a combination with a rotary knob operable by the user to adjust parameters on at least one of said control module, an accessory control module a power supply and another controller.

11. In a combination with a model train including at least a pair of motor powered rail vehicles coupled together, a control system comprising:

(a) a controller, (b) a control module installed on each of said at least pair of motor powered rail vehicles, (c) at least one way communication between said controller and a control module in said each of said at least pair of motor powered rail vehicles, (d) wherein said control module receives a motor command signal from said controller, and (e) wherein at least one control module adjusts a motor power of a respective motor powered rail vehicle in a response to said received motor command signal so that a motive power of said respective motor powered rail vehicle substantially matches a motive power representative by said received motor command signal.

12. The model train control system, according to claim 11, wherein at least one control module receives a minimum power start command signal from said controller so as to substantially break a static friction of a respective motor powered rail vehicle.

13. The model train control system of claim 11, wherein said control module contains therewithin at least one identification parameter and at least one operating parameter of said at least one motor powered rail vehicle and wherein said controller interrogates said control module and at least imports said at least one identification parameter and said at least one operating parameter.

14. The model train control system of claim 11, wherein said controller includes a housing being so sized and shaped that said controller is held by an operator of said model train railroad.

15. The model train control system of claim 11, wherein said controller includes at least one graphics based operator interface.

16. The controller of claim 15, wherein said at least one graphics based operator interface uploads a configuration information contained therewithin to said control module.

17. The model train control system of claim 15, wherein said at least one graphics based operator interface includes a graphical touch screen providing selection of control functions, wherein each control function is represented by a unique icon on said touch screen for use by said operator of said model train railroad.

18. The model train control system, according to claim 11, wherein said controller stores, in memory, a file structure containing graphical images and other information required for control of said at least one motor powered rail vehicle in a predetermined framework.

19. The model train control system of claim 11, further including at least one train accessory and wherein said at least one operator interface controls said at least one train accessory.

20. A method of moving two or more motor powered rail vehicles in a model train railroad with a controller, each of said two or more motor powered rail vehicles having a control module disposed therewithin, said method comprising the steps of:

(a) receiving, at a control module on a lead motor powered vehicle, commands signals from said controller, wherein one of said command signals is a movement reference control signal;

(b) communicating, with said control module on said lead motor powered rail vehicle, a motor power value to a control module disposed on remaining motor powered rail vehicle or vehicles; and (c) matching, at said control module on said disposed on remaining motor powered rail vehicle or vehicles, said motor power value communicated from said lead motor powered rail vehicle in step (b).

* * * * *